US005325437A

United States Patent [19]

Doi et al.

[11] Patent Number: 5,325,437

[45] Date of Patent: Jun. 28, 1994

[54] APPARATUS FOR REDUCING NOISE IN SPACE APPLICABLE TO VEHICLE COMPARTMENT

[75] Inventors: Kazuhiro Doi, Yokohama; Akio Kinoshita, Fujisawa; Kenichiro Muraoka, Yokohama, all of Japan

[73] Assignee: Nissan Motor Co., Ltd., Yokohama, Japan

[21] Appl. No.: 996,970

[22] Filed: Dec. 23, 1992

[30] Foreign Application Priority Data

Dec. 27, 1991 [JP] Japan ..... 3-347407

[51] Int. Cl.[5] ..... G10K 11/16

[52] U.S. Cl. ..... 381/71; 381/86

[58] Field of Search ..... 387/71, 94, 86

[56] References Cited

U.S. PATENT DOCUMENTS 5,111,507 5/1992 Nakahi .

FOREIGN PATENT DOCUMENTS 2149614A 6/1985 United Kingdom .

OTHER PUBLICATIONS

Elliott et al. "A Multiple Error LMS Algorithm and Its Application to the Active Control of Sound and Vibration", IEEE Transactions on Acoustics, vol. ASSP-35, No. 10, Oct. 1987, pp. 1423-1433.

*Primary Examiner*—Forester W. Isen

*Attorney, Agent, or Firm*—Lowe, Price, LeBlanc & Becker

[57] ABSTRACT

In an apparatus for reducing noises in a space, signals related to noise generating conditions of a plurality of noise sources are detected, a signal component of the detected signals is selected on the basis of determination of which signal component is predominant over the other signal component in the noises in the space, and the selected signal component is filtered through adaptively determined filter coefficients to output drive signals to control sound source, the filter coefficients being updated through a control algorithm so as to reduce a residual noise of a residual noise detector such as microphones. The signal components to be selected include a signal component having a relatively high auto-correlated function characteristic and a signal component having a random characteristic.

17 Claims, 10 Drawing Sheets

APPARATUS FOR REDUCING NOISE IN SPACE APPLICABLE TO VEHICLE COMPARTMENT

BACKGROUND OF THE INVENTION:

1. Field of the Invention

The present invention relates to an apparatus for reducing noises in a space such as a vehicular compartment or a cabin of a fuselage, or so on.

2. Description of the Background Art

FIG. 1 shows a circuit block diagram of a previously proposed noise reduction controlling apparatus exemplified by a British Patent Application Publication No. 2 149 614 published on Jun. 12, 1985 (corresponding to a Japanese PCT Application Publication No. Heisei 1-501344).

The previously proposed noise reduction controlling apparatus shown in FIG. 1 is applicable to the space such as cabin or like space.

In details, in a space 101, a plurality of loud speakers 103*a*, 103*b*, 103*c*, and a plurality of microphones 105*a*, 105*b*, 105*c*, and 105*d* are disposed at respective positions of the space. Control sounds are generated from the loud speakers 103*a*, 103*b*, and 103*c* as to interfere with the noise sounds.

Then, residual noises (residual difference noise signals) are measured by means of the microphones 105*a*, 105*b*, 105*c*, and 105*d*. A signal processor 107 is connected to each of the loud speakers 103*a*, 103*b*, and 103*c* and the microphones 105*a*, 105*b*, 105*c*, and 105*d*.

The signal processor 107 receives a basic frequency of a noise source measured by basic frequency measuring means and input signals from the microphones 105*a*, 105*b*, 105*c*, and 105*d* and outputs drive signals to the respective loud speakers 103*a*, 103*b*, and 103*c* so that sound pressure levels within the enclosed space 101 can be minimized.

If the previously proposed noise reduction controlling apparatus disclosed in the above-identified British Patent Application Publication were merely applied to the noise reduction controlling apparatus which reduces noises of a composite input from the periodic signal caused by the engine vibrations and random signal caused by the road surface, the following disadvantages might be raised.

That is to say, in a case where either of the periodic signal and random signal has a higher amplitude than that of the other signal, it is unavoidable that a resolution of a control system needs to be set with reference to the higher amplitude input signal. Therefore, the resolution for the smaller amplitude input is reduced so that a favorable effect of control cannot be achieved.

In addition, it would be possible to perform control using separate (two sets of) signal processors 107 with the periodic signal caused by the engine vibration and random signal caused by the road surface input being picked up by means of respectively separate detectors at different detection points.

However, the whole control system becomes accordingly complicated, becomes expensive, and large sized. Consequently, the apparatus for reducing the noises described above may become unsuitable for that used for the application to the automotive vehicle.

SUMMARY OF THE INVENTION

It is, therefore, a main object of the present invention to provide an improved apparatus for reducing noises in a space such as a vehicular compartment caused by a plurality of noise sources with a reduced cost, reduced size of construction and with more favorable effect of noise reduction control.

The above-described object can be achieved by providing an apparatus for reducing noises in a space, comprising: a) control sound source for generating a control sound to be interfered with the noises so as to reduce the noises at an evaluation area of the space; b) first means for detecting a residual noise at a predetermined position of the space after the interference with the noises; c) second means for detecting signals related to noise generating conditions of a plurality of noise sources; d) third means for selecting either of first or second signal component from detected signals related to the noise generating conditions of the second means as a signal component predominant over the other signal component in the generating noises in the space, the first signal component having a relatively high auto correlation function characteristic and the second signal component having a random characteristic; e) an adaptive digital filter for processing a selected signal component output from said third means by means of adaptively determined filter coefficients and outputting a drive signal to drive the control sound source; and f) fourth means for updating the filter coefficients using a control algorithm on the basis of the output signal from said second means and the selected signal component of said third means so as to reduce the output signal from the third means.

The above-described object can also be achieved by providing an apparatus for reducing noises in a space, comprising: a) control sound source means for generating a control sound to be interfered with the noises at an evaluation area of the space so as to reduce the noises at the evaluation area; b) residual noise detecting means for detecting a residual noise at a predetermined position of the space after the interference with the noise; c) a single noise generating condition sensor which is so constructed as to detect signals related to noise generating conditions of a plurality of noise sources; d) signal component separating means for separating the detected signals from the noise generating condition sensor into both first and second signal components, said first signal component having a relatively high auto correlated function characteristic and said second signal component having a random characteristic; e) separated signal component selecting means for selecting either first or second signal component which is predominant in the noises in the interior of space over the other signal component; f) an adaptive digital filter which is so constructed as to adaptively filter process the selected signal component from the separated signal component selecting means through adaptively determined filter coefficients and to output a drive signal to drive the control sound source means; and g) an adaptive controller which is so constructed as to update the adaptively determined filter coefficients through a predetermined control algorithm on the basis of the output signal of the residual noise detecting means and selected signal component from said separated signal component selecting means to reduce the detected residual noise.

DETAILED DESCRIPTION OF THE PREFERRED EMBODIMENTS

Reference will, hereinafter, be made to the drawings in order to facilitate a better understanding of the present invention.

Figure 1:
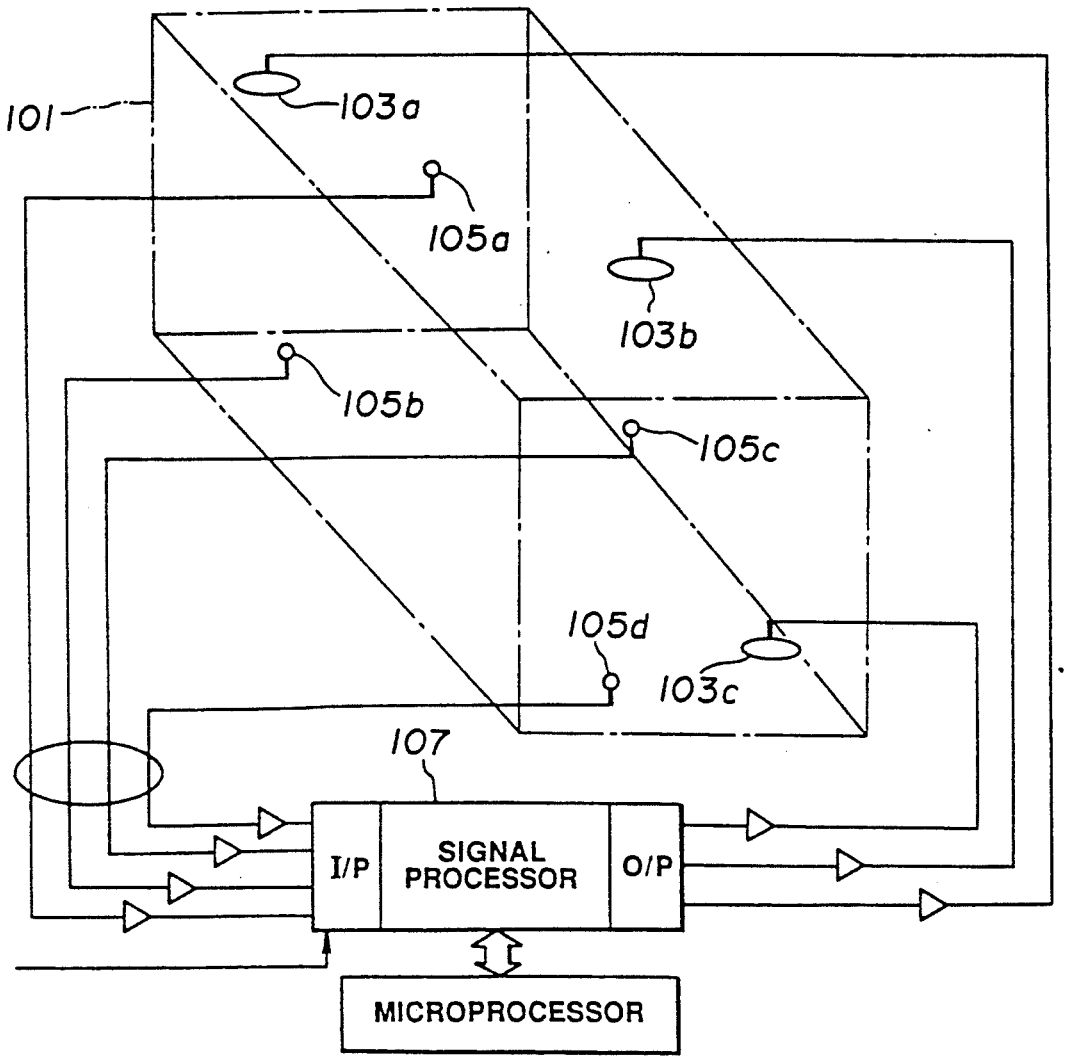
FIG.1 (PRIOR ART)
FIG. 1 is a circuit block diagram of a previously proposed noise reduction controlling apparatus disclosed in the British Patent Application Publication No. 2 149 614.

FIG. 1 has already been explained in the BACKGROUND OF THE INVENTION.

First Preferred Embodiment

Figure 2:
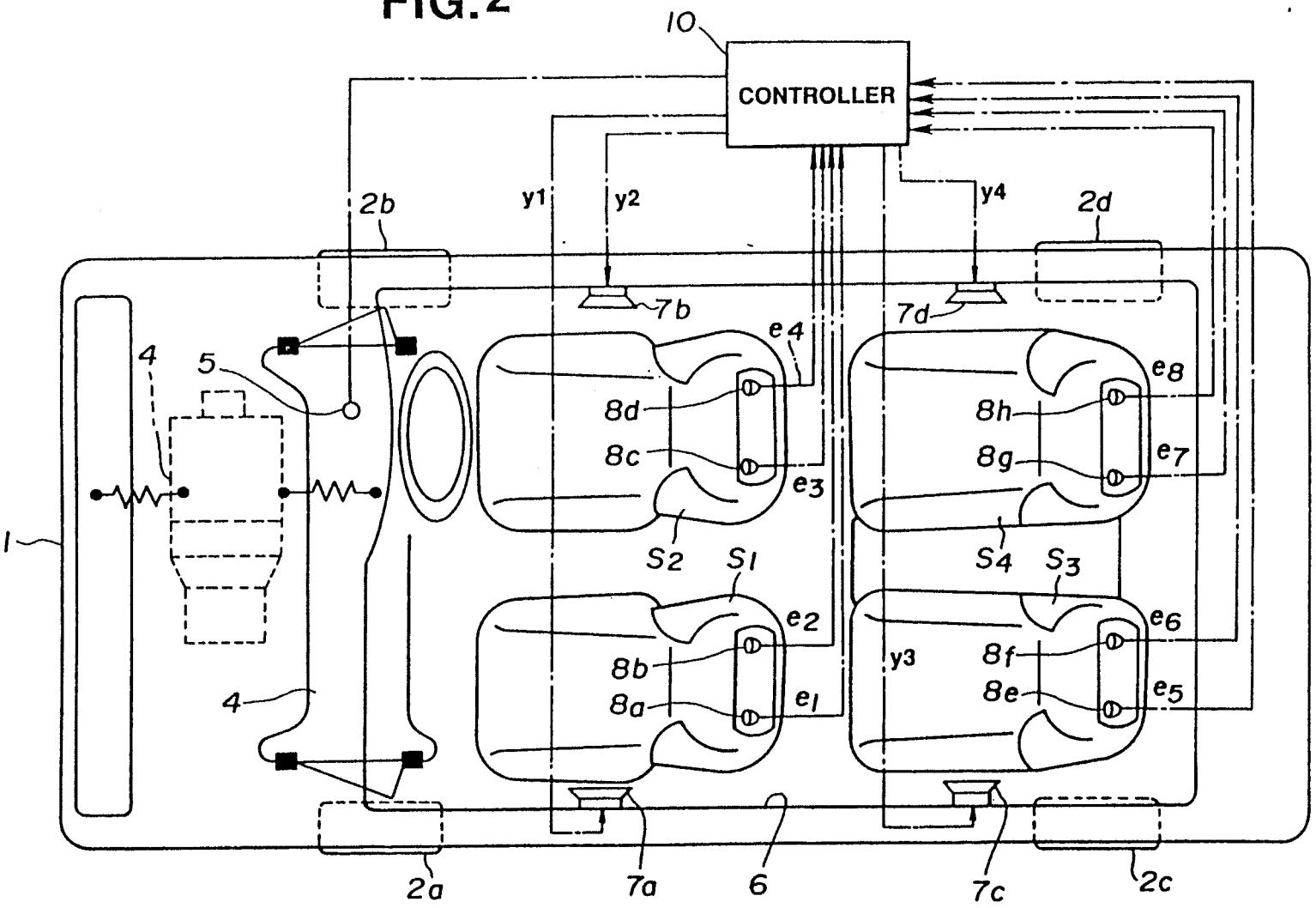
FIG. 2 is a wiring diagram of an apparatus for reducing noises in a space applicable to a vehicular compartment in a first preferred embodiment according to the present invention.

FIG. 2 shows a first preferred embodiment of an noise reducing apparatus according to the present invention applicable to a space, i.e., to a vehicular compartment.

A vehicle body 1 is supported by means of front tire wheels 2*a* and 2*b* and rear tire wheels 2*c* and engine 4 disposed in a front part of the vehicle body 1 drives the front tire wheels 2*a* and 2*b*. The vehicle is, so-called, a front-engine front wheel-drive (FF) type car.

A suspension vibration involved in tire wheel vibration caused by a roughness on a road surface on which the vehicle runs and engine vibration provide noise sources of the space of the vehicle compartment. A single acceleration detector 5 is used to detect both suspension vibration and engine vibration, as means for detecting noise generating conditions of the noise sources.

The acceleration detector 5 is installed on a subframe 4 located on the front part of the vehicle body 1

In details, the acceleration detector 5 is installed on the front subframe 4. The subframe 4, as shown in FIG. 3, is attached with a front wheel suspension link 30 via a bush 31 and the engine 4 is attached thereto via a mount insulator 33.

Figure 3:
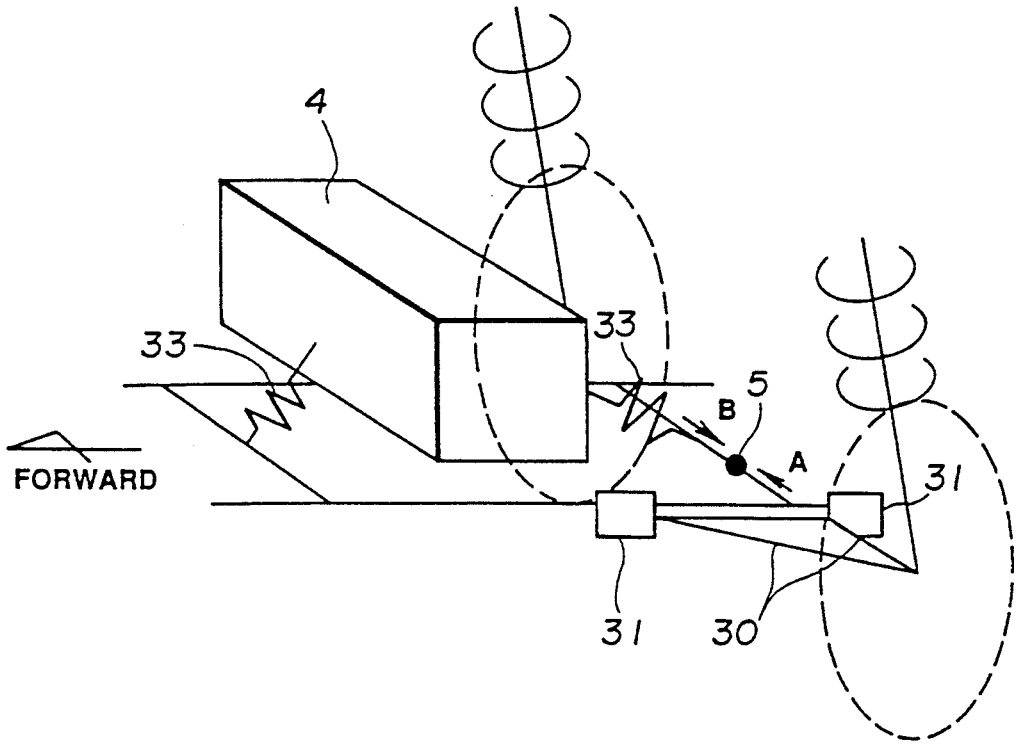
FIG. 3 is a perspective view of arrangement of an acceleration detector used in the first preferred embodiment shown in FIG. 2.

Hence, the acceleration detector 5 mounted on the front subframe 4 serves to detect the road surface vibration signal input from the road surface to the suspension and the vibration signal input from the engine in arrow-marked directions A, and B shown in FIG. 3 and the detected signals providing a signal (acceleration) (x) which has a correlation to the noise in the space of the vehicle compartment 6.

In addition, referring to FIG. 2, loud speakers 7*a*, 7*b*, 7*c*, and 7*d* are disposed on door portions opposing front seats S1 and S2 and rear seats S3 and S4, respectively, as control sound source in the vehicle compartment 6 which constitutes an acoustic closed space of the vehicle body 1.

A plurality of microphones 8*a* through 8*h* are disposed on head rest positions of each occupant seat S1 through S4 as means for detecting residual noises.

The residual noises in the vehicle compartment 6 to be input into the microphones 8*a* through 8*h* are converted into noise signals e1 through e8 in the form of electrical signals according to sound pressures of the residual noises.

The output signals derived from the acceleration detector 5 and microphones 8*a* through 8*h* are individually supplied to a controller 10. The drive signals y1 through y4 output from the controller 10 are individually supplied to the loud speakers 7*a* through 7*d* so that acoustic signals (control sounds) are output from the loud speakers 7*a* through 7*d* to the space of the vehicle compartment 6.

Figure 4:
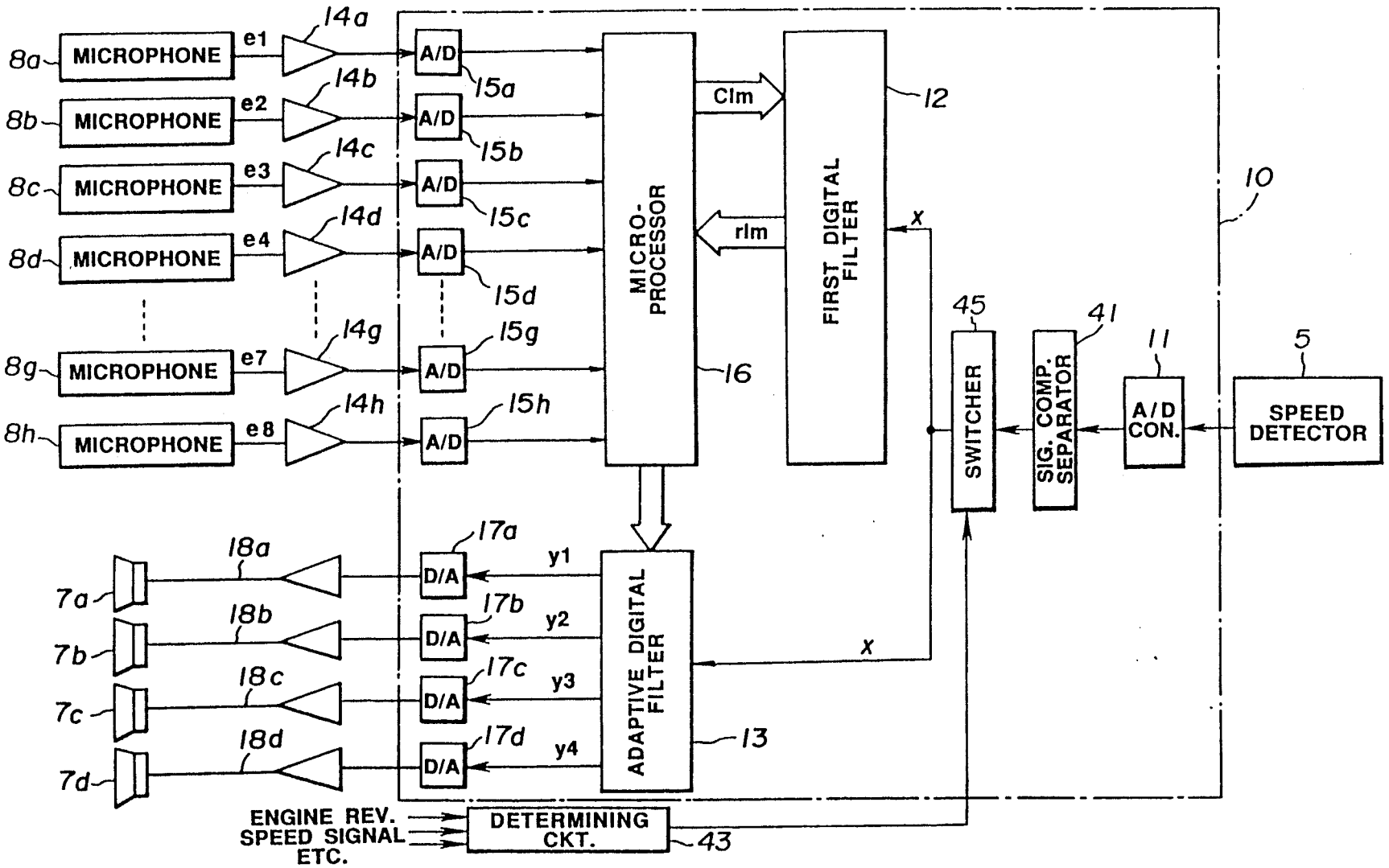
FIG. 4 is a circuit block diagram of the noise reduction controlling apparatus in the first preferred embodiment shown in FIGS. 2 and 3.

FIG. 4 shows an internal structure of the controller 10 and its peripheral circuitry.

The controller 10 includes a first digital filter 12, second digital filter (adaptive digital filter) 13, and microprocessor (adaptive controller) 16. The acceleration signal x input from the acceleration detector 5 is converted into a digital signal by means of an A/D converter 11. The digitally converted acceleration signal x is supplied to the first digital filter 12 and adaptive digital filter 13 as a reference signal x via a signal component separator 41, and a switcher 45. The switcher 45 receives an input from a determining circuit 43.

In addition, the noise signals e1 through e8 which are output signals of the microphones 8*a* through 8*h* are amplified by means of amplifiers 14*a* through 14*h* and analog-to-digital converted by means of A/D converters 15*a* through 15*h*. The microprocessor 16 receives the A/D converted noise signals together with the output signal of the first digital filter 12.

The first digital filter 12 inputs the acceleration signal x and generates the filtered reference signal rlm (refer to equations (4) and (5)) according to a number of combinations of transfer functions between the respective microphones 8*a* through 8*h* and loud speakers 7*a* through 7*d*.

The adaptive digital filter 13 is functionally provided with a plurality of filters which correspond to the number of output channels to the loud speakers 7*a* through 7*d*. The adaptive digital filter 13 receives the acceleration signal x and outputs speaker drive signals y1 through y4 after an adaptive signal processing (filter processing) is carried out on the basis of filter coefficients Wmi (refer to equation (5)) which are presently set. Hence, the adaptive digital filter 13 serves to filter the output signal of the switcher 45 (separate signal component selecting means) through adaptively determined filter coefficients and to output drive signals y1 through y4, the output drive signals driving the control sound source.

The drive signals y1 through y4 are digital-to-analog converted by means of D/A converters 17*a* through 17*d* and output to the respective loud speakers 7*a* through 7*d* via amplifiers 18*a* through 18*d*.

The microcomputer 16 inputs the noise signals e1 through e8 and filtered reference signal $r_{lm}$ and updates the filter coefficients so that the output signals from the adaptive digital filter 13 provides target signal waveforms using the LMS algorithm which is a kind of a steepest descent method.

Hence, the microprocessor 16 updates the filter coefficients of the adaptive digital filter 13 using the predetermined control algorithm so that the levels of output signals of the residual noise detecting means are reduced on the basis of the output signals of the microphones 8*a* through 8*h* (residual noise detecting means) and output signals of the switcher 45 (as separated signal component selecting means).

FIG. 4 diagrammatically shows a functional block diagram of the signal component separator 41, switcher 45, and determining circuit 43.

Figure 5:
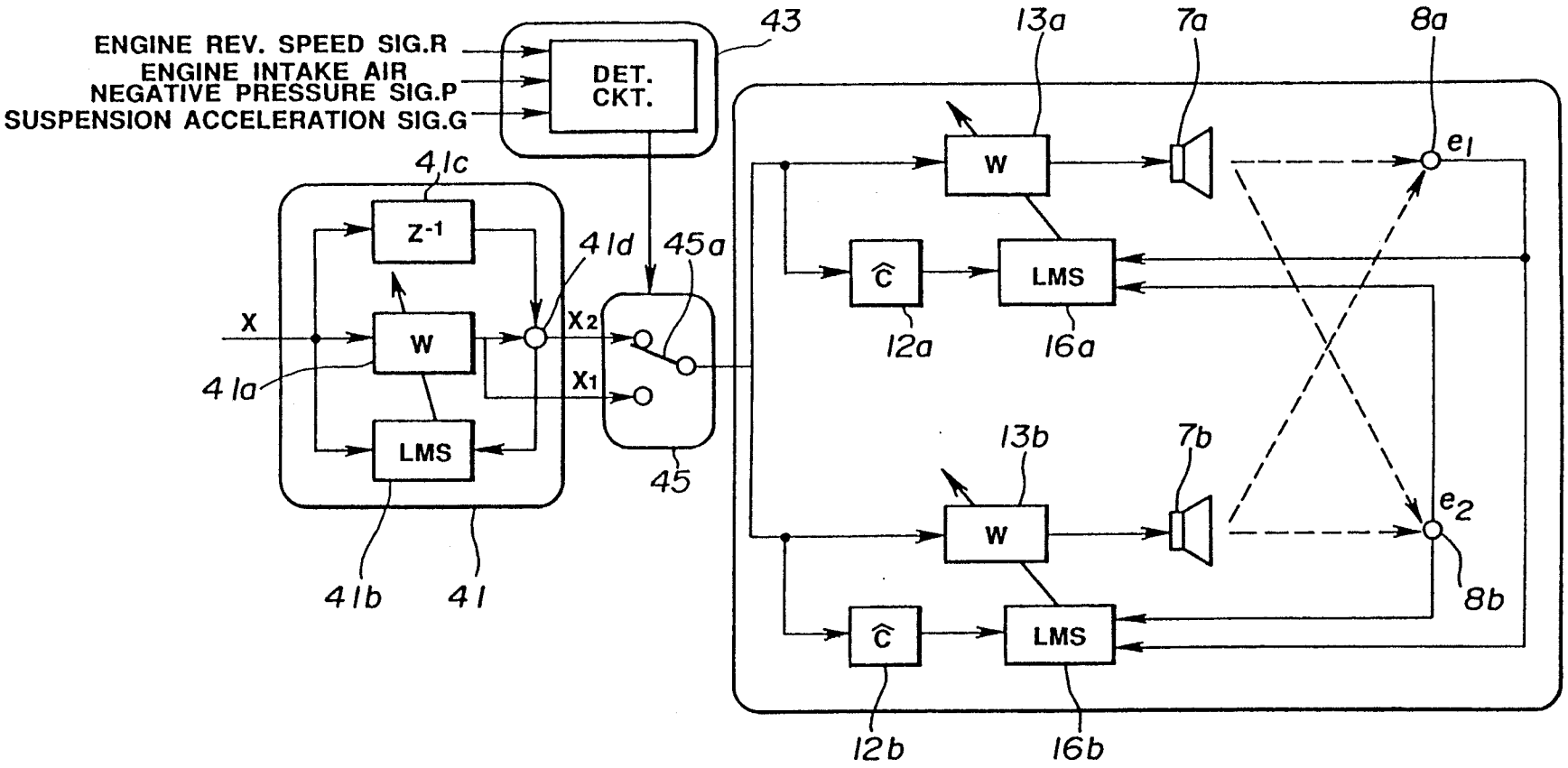
FIG. 5 is a functional circuit block diagram of the first preferred embodiment shown in FIG. 4 in another format of expression.

FIG. 5 is an alternation of FIG. 4 in a different format of representation.

For simplicity of explanation, only two loud speakers 7*a* and 7*b* and two microphones 8*a* and 8*b* are shown in FIG. 5. Then, the first digital filter 12, adaptive digital filter 13, and microprocessor 16 are shown so as to correspond to the two loud speakers 7*a* and 7*b*, i.e., shown are two first digital filters 12*a* and 12*b*, adaptive digital filters 13*a* and 13*b*, and two microprocessors 16*a* and 16*b*.

On the other hand, the signal component separator 41 includes a separator use digital filter 41*a*, separator use microprocessor 41*b*, separator use delay 41*c*, and separator use adder 41*d*.

The separator use digital filter 41*a* filters the output signal of the acceleration detector 5 by means of a predetermined filter coefficient W.

The separator use microprocessor 41*b* updates the filter coefficient W of the separator use adder 41*d* using the LMS algorithm as will be described later so that the output signal of the separator use adder 41*d* is minimized on the basis of the acceleration signal X of the acceleration detector 5 and output signal of the separator use adder 41*d*.

Hence, the output signal of the separator use digital filter 41*a* indicates a signal component $X_1$ which provides a high auto-correlation function characteristic. The output signal of the separator use adder 41*d* provides a signal component $X_2$ having a random characteristic so that the acceleration signal X derived from the acceleration detector 5 is separated into two signal components $X_1$ and $X_2$ which are input to the switcher 45.

The determining circuit 43 determines a predominant signal component in the noises from the separated signal components using one or more signals from among a signal indicating an engine revolution speed of the vehicular engine, a signal indicating an intake air negative pressure of the vehicular engine, a signal indicating a suspension acceleration, a signal indicating a vehicular acceleration, and output signals derived from the microphones.

In the first embodiment, the determining circuit 43 receives the engine revolution indicative signal, engine intake air negative pressure indicative signal, and suspension acceleration indicative signal.

That is to say, in a case where the engine revolution speed corresponds to a cavity resonance frequency inherent in the vehicle compartment 6. Alternatively, in a case where the intake air negative pressure is large and the engine falls in an abrupt acceleration condition, the determining circuit 43 determines that any one of the frequency components which has the high auto-correlation function characteristic caused by the engine vibration is predominant in the vehicular compartment noises. In addition, when the suspension input is large, the determining circuit 43 determines that the component input from the road surface (random signal component) is predominant in the vehicular compartment noises.

The switcher 45 is provided with a switch 45*a* for selectively operating, in response to a determination signal of the determining circuit 43, one of the auto-correlated function signal component $X_1$ and nrandom signal component $X_2$.

Hence, the signal component separator 41 serves as signal component separating means for separating the output signal of the acceleration detector 5 as the noise generating condition detecting means into the signal component having the high auto-correlation function characteristic and that having the random characteristic.

Both determining circuit 43 and switcher 45 constitute separated signal component selecting means which selects either of the component signals which is predominant in the vehicle compartment noises over the other signal component.

Furthermore, the signal component separator 41, determining circuit 43, and switcher 45 constitute signal component selecting means which selects either of the signal component having the high auto-correlation function characteristic and random characteristic signal component as the predominant signal component in the space according to the output signal of noise generation condition detecting means.

A theory of operation on control of reduction in the noises according to the adaptive noise signal processing method in the first embodiment executed by the controller in the first embodiment will be described using general formulae expressed in attached table 1.

It is noted that although the theory of operation is applicable to the signal component separator 41, the following explanation is devoted only to the theory of operation concerning the noise reduction control by means of the controller 10.

Suppose now that the noise signal detected by means of l number microphone is denoted by el(n), the residual noise detection signal detected by the l number microphone when the control sound (secondary sound) is not present from the loud speakers 7*a* through 7*d* is denoted by epl (n), one of the filter coefficients which corresponds to a J (J=0, 1, 2, ---, Ic−1) [Ic denotes the constant] number transfer function (FIR (Finite Impulse Response) Hlm between m number loud speaker and l number microphone is denoted by Clmj, the reference signal is denoted by X (n), and an i number filter coefficient (i =0, 1, ---, Ik −1) of the adaptive filter which drives the m number loud speaker upon receipt of the reference signal is denoted by Wmi.

Then, an equation (1) expressed in an attached table 1 is established.

In the equation (1), any term to which (n) is incorporated denotes a sampled value at a predetermined sampling time n , M denotes a number of loud speakers (in the first embodiment, four), Ic denotes a number of taps (filter order) of the filter coefficients Clm represented by the FIR digital filter, and Ik denotes a number of taps (filter order) of the filter coefficients Wmi.

In the equation (1), the term of the right side "{ΣWmi ×(n−j−i)} (=ym)" represents the output when the reference signal x is input to the adaptive digital filter 13, a term of represents a signal when a signal energy electrically input to the m number speaker is converted and output from these speakers as acoustic energy and is reached to the l number microphone via the transfer function Clm within the vehicle compartment 6, and the whole right side of "$\Sigma C_{lmj}$ {ΣWmi ×(n−j−i)}is the addition of the reaching signals to the l number microphone for all speakers and therefore a total sum of the control sounds reaching the 1 number microphone.

Next, a performance function (variable to be minimized) Je is expressed as an equation (2) of the attached table 1.

In the equation (2), L denotes the number of microphones (in the first embodiment, eight).

Then, in order to derive the filter coefficient Wmi which minimizes the performance function Je, the LMS algorithm is adopted in the first embodiment.

That is to say, the filter coefficient Wmi is updated by a value of the performance function Je which is partially differentiated with respect to each filter coefficient $W_{mi}$.

Hence, according to the equation (2), an equation (3) in the attached table 1 will be established:

On the other hand, an equation (4) of the attached table 1 will be established from the equation (1).

If a right side of the equation (4) is replaced with rlm (n−i), a rewriting equation of the next filter coefficient can be derived according to an equation (5) expressed in the attached table 1 in the form including a weight coefficient γl.

In the equation (5), α denotes a convergence coefficient and contributes to a speed at which the filter can optimally be converged or contributed to its stability.

Although the convergence coefficient α is treated as a single constant in the first embodiment, the converge coefficient may alternatively be such a converge coefficient as is different for each filter ($\alpha_{mi}$) or alternatively be calculated as such a converge coefficient (αl) as including the weight coefficient γl.

Next, an operational flowchart of the controller 10 with reference to FIGS. 6 and 7 will be described below.

Figure 6:
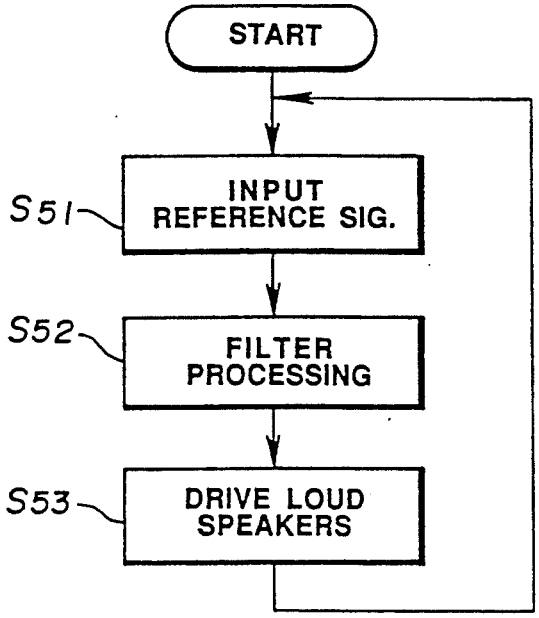
FIG. 6 is an operational flowchart of a controller shown in FIG. 2 for executing a drive of loud speakers.

FIG. 6 shows an operational flowchart executed by the controller 10 to output the speaker drive signal.

Figure 7:
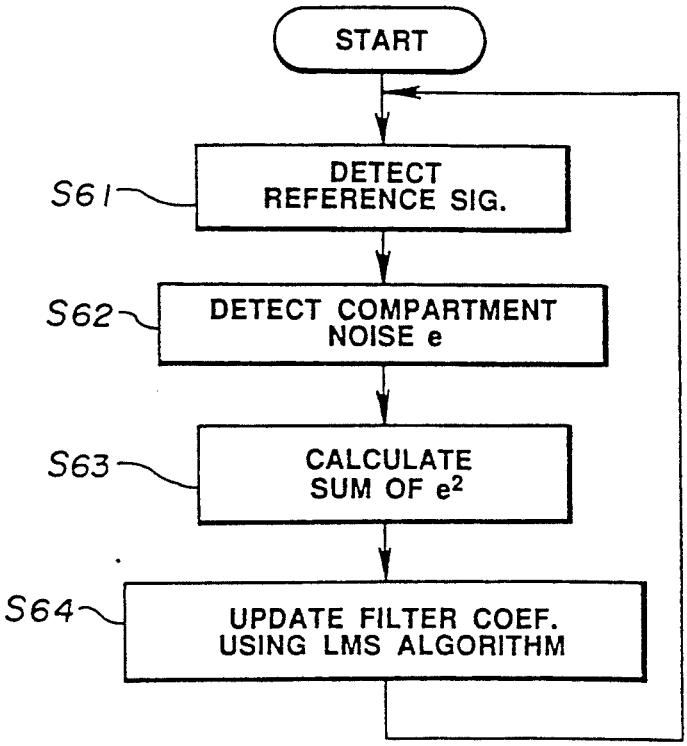
FIG. 7 is an operational flowchart of the controller shown in FIG. 3 for executing an updating of filter coefficients in the first preferred embodiment shown in FIGS. 2 through 6.

FIG. 7 shows another flowchart to update the filter coefficients of the adaptive digital filter 13.

First, in a step S51, the acceleration detection signal is input. That is to say, the acceleration detection signal input from the acceleration detector 5 is converted into the corresponding digital signal and either of the periodic signal component $x_1$ or random signal component $x_2$ passed through the signal component separator 41 and switcher 45 is selected. As the reference signal x, the selection signal component is input to the adaptive digital filter 13 and first digital filter 12.

In a step S52, the reference signal x is filter processed. That is to say, the adaptive digital filter 13 carries out the filter processing on the basis of the presently set filter coefficients (refer to the equation (5) and flowchart of FIG. 6) and outputs the speaker drive signals y1 through y4.

In a step S53, the speakers are driven. In details, the speaker drive signals $y_1$ through $y_4$ are digital-to-analog converted by means of the D/A converters 17*a* through 17*d* and output to the loud speakers 7*a* through 7*d* via amplifiers 18*a* through 18*d*. Consequently, the loud speakers 7*a* through 7*d* output the secondary sounds of opposite phases to the noises transmitted from the front tire wheels 2*a* and 2*b* and rear tire wheels 2*c* and 2*d* to the vehicle compartment 6 so as to reduce the noises in the space of the vehicle compartment 6.

Referring to FIG. 7, in a step S61, the controller 10 carries out the reference signal detection. The reference signal detection is carried out through the acceleration signal detection as will be described later and through the signal component selection. That is to say, the first digital filter 12 inputs the selected reference signal x, generates the filtered reference signal rlm according to the number of combinations of the transfer functions between the microphones 8*a* through 8*h* and speakers 7*a* through 7*d*, and outputs the generated reference signal rlm to the microprocessor 16.

At the same time, in a step S62, the detection of the noises e in the interior of enclosed space of the vehicle compartment 6 is carried out. That is to say, when the secondary sounds are output through the loud speakers 7*a* through 7*d*, the noises in the enclosed space of the vehicle compartment 6 are canceled and their residual noises as the residual signals are detected by means of the microphones 8*a* through 8*h*. Then, the noise signals el through e8, the output signals of the microphones 8*a* through 8*h*, are amplified by means of the amplifiers 14*a* through 14*h* and thereafter analog-to-digital converted by means of the A/D converters and input to the microprocessor 16.

Next, in a step S63, a total sum of squares e2 of sound pressures is calculated (refer to the equation (2)).

In a step S64, the filter coefficients Wmi are updated using the LMS algorithm. That is to say, the equation (5) is calculated by the microprocessor 16 so that the square sum of the sound pressure becomes minimized on the basis of the reference signal rlm and total sum of the square sums e2 of the sound pressures, thus filter coefficients of the adaptive digital filter 13 being sequentially updated. Hence, the adaptively updated filter coefficients cause the reference signal x to be filter processed so that the loud speaker 7*a* through 7*d* can be driven. Consequently, the noise reduction in the space of the vehicle compartment 6 can be achieved.

Figure 8:
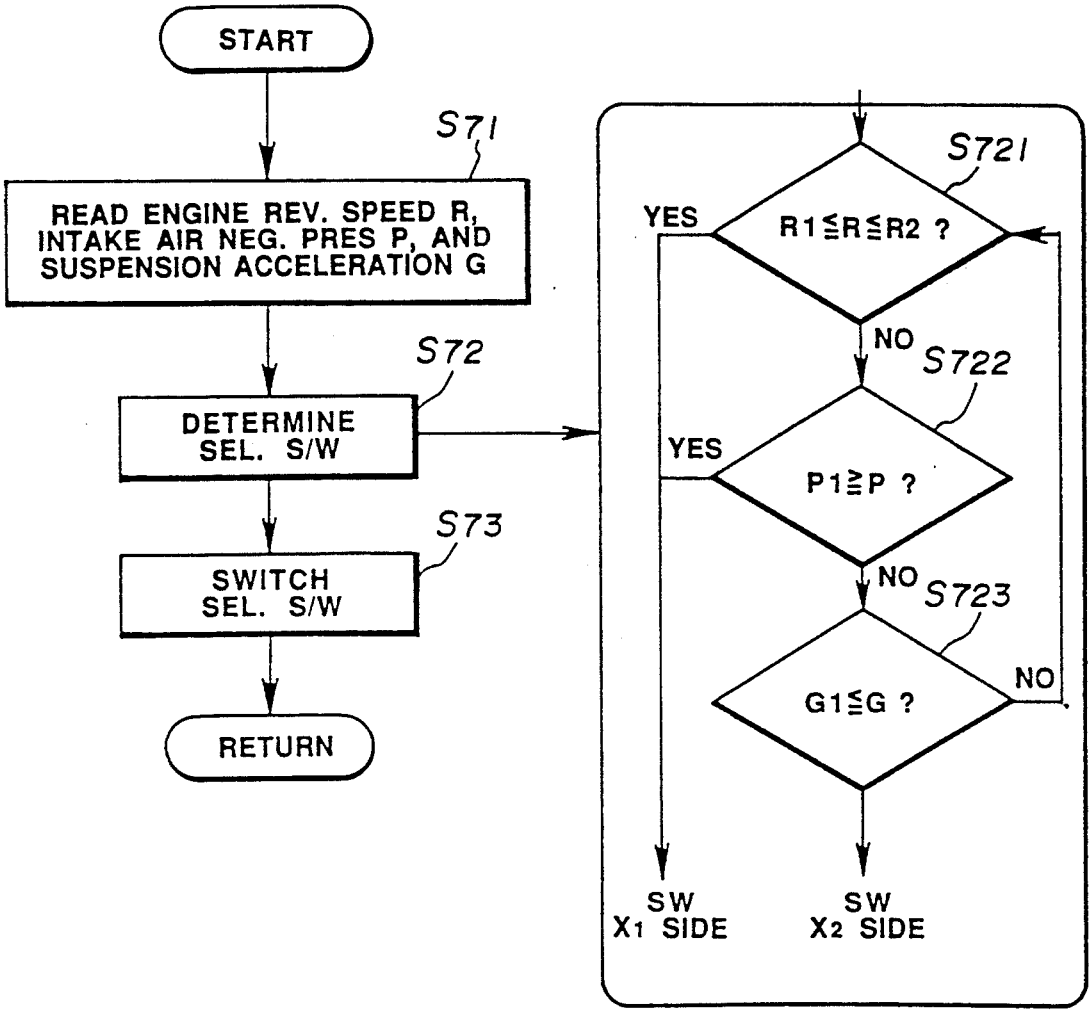
FIG. 8 is an operational flowchart of the controller shown in FIG. 2 for executing a selection of signal component in a signal component separator and a switch of a switcher shown in FIG. 2.

On the other hand, the selection of the signal components in the step S61 will be executed on the basis of the flowchart of FIG. 8.

That is to say, in a step S71, the determining circuit 43 reads the engine revolution detection signal, engine intake air negative pressure detection signal, and suspension acceleration detection signal.

In a step S72, the determination of the position of the selection switch 45*a*, i.e., the determining circuit 43 determines which direction the switch 45*a* of the switcher 45 should be turned to. In details, when the engine revolution speed falls in between R1 and R2 in the step S721, the engine revolution speed corresponds to the cavity resonance frequency in the interior of enclosed space of the vehicle compartment and the determining circuit 43 determines that the switch 45*a* should be switched to select the periodic signal component x1. It is noted that he engine revolution speed range of R1 through R2 is an engine revolution speed range in which the enclosed sound become critical.

In a step S722, the determined circuit 43 determines that the intake negative pressure P is lower than P1 and the engine falls in the abrupt acceleration condition. In this case, the switch 45*a* is determined to select the periodic signal component X1.

On the other hand, if the engine revolution speed does not fall in the range from R1 to R2 and the intake air negative pressure in higher than P1, the routine goes to a step S723.

In the step 723, the determining circuit 43 determines whether the suspension vibration exceeds G1.

If the suspension vibration exceeds G1, the road noise is large due to the run on a rough road and the determining circuit 43 determines that he switch 45*a* should be turned to select the random signal component X2.

Next, the routine goes to a step S73 in which the switch 45*a* is actually switched. Thus, the switch 45*a* of the switcher 45 is switched on the basis of the result of determination in the step S72.

According to the control described in FIGS. 6, 7, and 8, the reference signal x is selected depending on which signal component of, e.g., the periodic signal component involved in the engine revolutions and random signal component involved in the suspension vibration is predominant in the noises in the space of the vehicle compartment 6 according to the vehicle running condition so that an appropriate noise reduction control can be achieved.

In addition, since the noise reduction control can be carried out by a singled noise reduction controlling apparatus, the whole control apparatus can be small-sized.

Furthermore, since the single acceleration detector 5 can detect the sound information signal related to both the periodic signal component and random signal component, the number of signal sensors can be reduced.

It is noted that he acceleration detector 5 may be constituted by a piezoelectric element.

Second Preferred Embodiment

Figure 9:
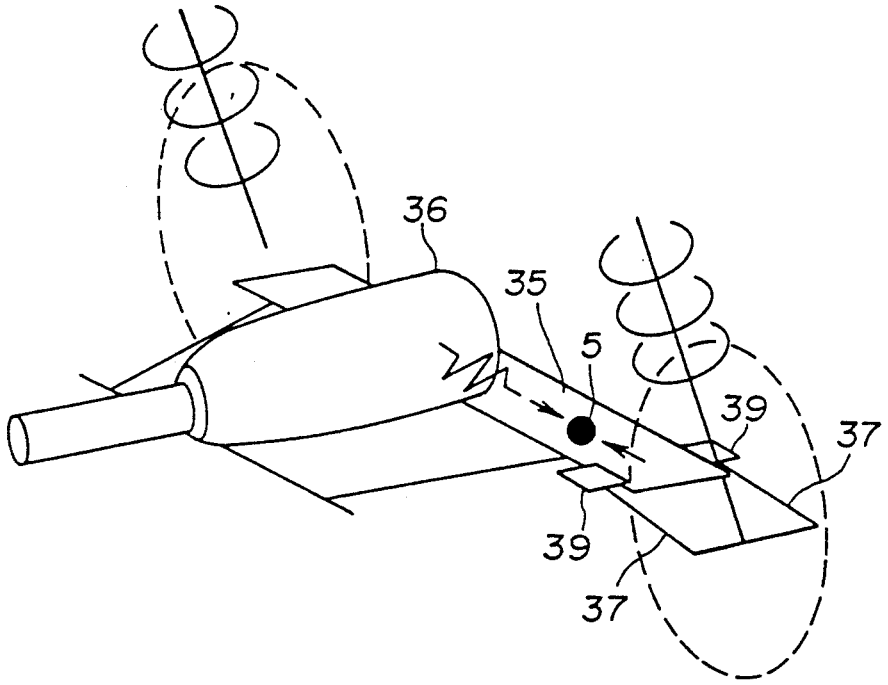
FIG. 9 is a perspective view of another arrangement of the acceleration detector in a second preferred embodiment of the noise reduction controlling apparatus.

FIG. 9 shows a second preferred embodiment of an apparatus for reducing noises in the space according to the present invention.

FIG. 9 is a perspective view corresponding to FIG. 3.

In the second embodiment, an arranged position of the acceleration detector 5 is different from that in the first embodiment shown in FIG. 3.

In details, in a case of a forward-engine-rear wheel-drive (FR) type car to which the noise reducing apparatus according to the present invention is applicable, the acceleration detector 5 is, in turn, mounted on a rear banjo-type axle housing 35. The banjo-type axle housing 35 is fixed onto the casing of final gear drive 36 so that a vibration in a rear differential unit is transmitted to the acceleration detector 5. In addition, a link 37 of a rear suspension is attached to an outer end of the axle housing 35 via a bush 39 so that a vibration from a road surface is transmitted to the acceleration detector 5.

Hence, when the noise reduction control in the case of the first embodiment is carried out in the second embodiment, both road surface noise and rear differential unit vibration can be reduced.

It is noted that is is possible to reduce the noises by combining both acceleration detectors 5 in the case of the first embodiment shown in FIG. 3 and in the case of the second embodiment shown in FIG. 9 as noise generating condition detecting means.

Third Preferred Embodiment

Figure 10:
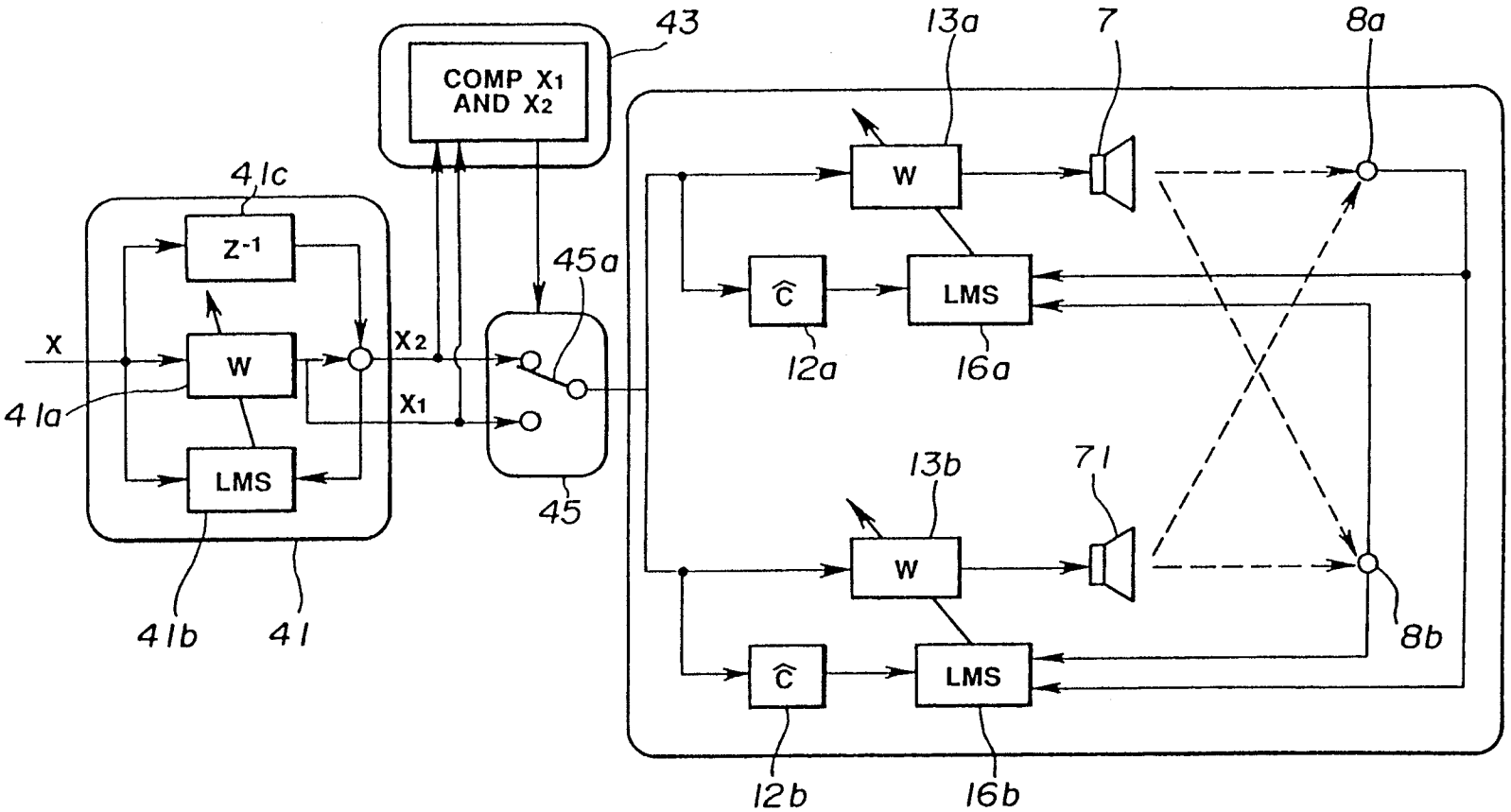
FIG. 10 is a circuit block diagram of the noise reduction controlling apparatus in a third preferred embodiment according to the present invention.

FIG. 10 shows a circuit block diagram of the noise reducing apparatus in a third preferred embodiment according to the present invention.

In the third embodiment, both periodic signal component $X_1$ and random signal component $X_2$ which are mutually separated by means of the separator 41 are directly compared with each other in their levels and a higher level signal component is selected.

In this third embodiment, the determining circuit 43 receives both of the periodic signal component $X_1$ and random signal component $X_2$ to determined either of which signal components has a higher amplitude.

The determination result is output to the switcher 45.

In details, the determining circuit 43 determines whether, for example, a value of the random signal component X2 multiplied by a coefficient k has higher amplitude than that of the periodic signal component X2 and outputs the selection signal to the switcher 45.

The coefficient k is set on the basis of, e.g., a sensory inspection result for noises in, for example, the vehicle compartment, i.e., the interior of the enclosed space. As a method of determining the coefficient k according to the result of sensory inspection is such that when both of a single frequency spectrum noise and random noise are generated at different times, respectively, an amplitude ratio of the signal inputs at the time when the same sound pressures are produced or of signal inputs at the time when both of the generated sound pressure levels are evaluated to be unpleasant level is used to determine the coefficient k which is determined so as to correct a difference of the sensory inspection according to properties of the signals.

Figure 11:
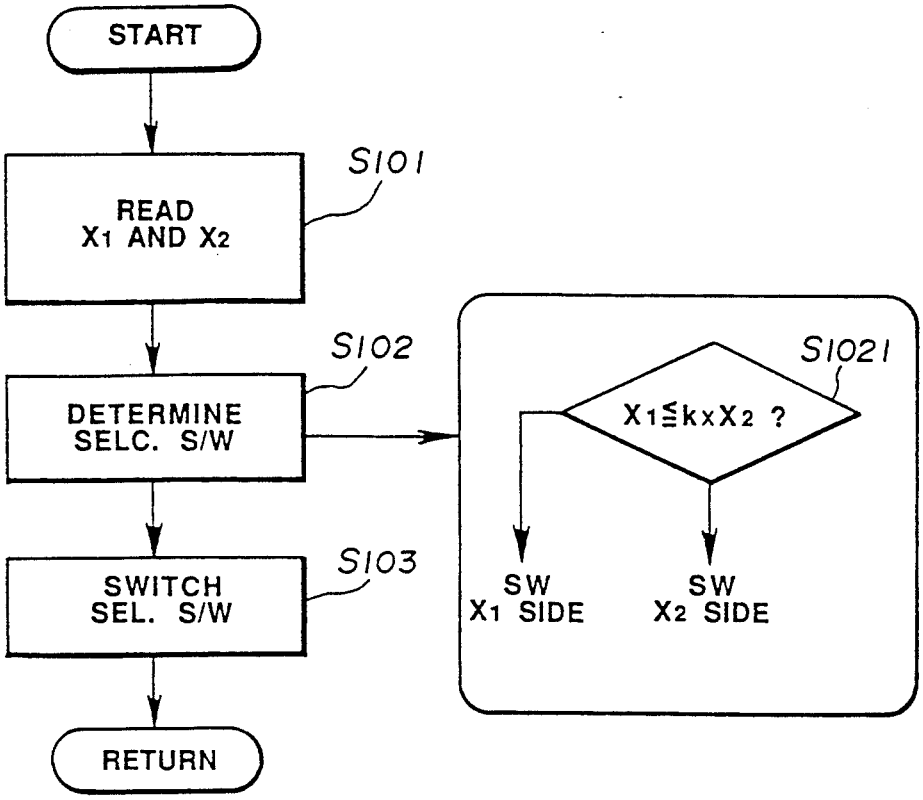
FIG. 11 is an operational flowchart of the controller for executing a signal component selection in the case of the third preferred embodiment shown in FIG. 10 according to the present invention.

FIG. 11 shows an operational flowchart of selecting the signal component in the third embodiment.

In a step S101, the determining circuit 43 reads the reference signal x, i.e., both periodic signal component $X_1$ and random signal component $X_2$.

In a step S1021, the determining circuit 43 determines whether the level of $x_1$ is equal to or lower than $k \times x_2$ or higher than $k \times x_2$.

If $x_1$ is equal to or lower than $k \times x_2$, the determining circuit 43 outputs the determination signal indicating that the random signal component $x_2$ should be selected. If $x_1$ is higher than $k \times x_2$, the determining circuit 43 outputs the determination signal to select the periodic signal component $x_1$.

In a step S103, the determining circuit 43 determines the switched direction of the switch 43*a* on the basis of determination result in the step S102. This switching is carried out by means of the switch 45*a* of the switcher 45 in response to the output determination signal of the determining circuit 43.

Hence, the effect achieved by the noise reducing apparatus in the case of the third embodiment is the same as that achieved in the case of the first embodiment.

In addition, a high-speed processing becomes possible. It is not necessary to detect the engine revolution speed signal, intake air negative pressure signal, and suspension acceleration signal. Thus, far less expensive reducing apparatus can be achieved.

It is noted that the present invention is not limited to the above-described embodiments.

For example, the acceleration detector 5 as the noise generating condition detecting means may be installed so as to separately detect the engine vibration and suspension vibration and the signal component selecting means may be constituted by means for selecting either of the signal components which has high auto-correlation function characteristic or which has the random characteristic, the selected signal component being a signal component which is predominant over the noises of the space. In addition, the evaluating point or area may be spaced apart from the positions of the microphones since the residual noises at the evaluating point may be estimated on the basis of a predetermined ratio and the noise reduction control through the microphones can be carried out.

In addition, the updating algorithm for the filter coefficient in the adaptive digital filter may not only be the LMS algorithm in a time domain but also may be an LMS algorithm in a frequency domain. Another type of algorithm may be used.

Furthermore, the present invention is applicable to a vibration reduction control apparatus for reducing vibrations occurring on, e.g., output shaft of a vehicular power transmission or so on.

As described hereinabove, since, in the present invention, the noise reducing apparatus can select either the signal components and control the noises generated due to the propagation of signal component which has high auto-correlation function characteristic or due to the propagation of the signal component which has the random characteristic, the selected signal component being predominant in the noises, an appropriate control for the noise reduction can be achieved even though the noises based on either signal component may be.

In addition, the size of the noise reduction controlling apparatus can be reduced since the apparatus is of, so-called, selection and control type. Its cost reduction of manufacture may accordingly be achieved.

It will fully be appreciated by those skilled in the art that the foregoing description is made in terms of the preferred embodiments and various changes and modifications may be made without departing from the scope of the present invention which is to be defined by the appended claims.

What is claimed is:

1. An apparatus for reducing noises in a space, comprising:

a) control sound source for generating a control sound to be interfered with the noises so as to reduce the noises at an evaluation area of the space;

b) first means for detecting a residual noise at a predetermined position of the space after the interference with the noises;

c) second means for detecting signals related to noise generating conditions of a plurality of noise sources;

d) third means for selecting either of first and second signal components from detected signals related to the noise generating conditions of said second means as a signal component predominant over the other signal component in the generating noises in the space, the first signal component having a relatively high auto-correlated function characteristic and the second signal component having a random characteristic;

e) an adaptive digital filter for adaptively filter processing a selected signal component output from said third means by means of adaptively determined filter coefficients and outputting a drive signal to drive said control sound source; and f) fourth means for updating the predetermined filter coefficients using a control algorithm on the basis of the output signal from said second means and the selected signal component of said third means so as to reduce the output signal from the third means.

2. An apparatus for reducing noises in a space as set forth in claim 1, wherein said second means includes a noise generating condition sensor which is so constructed as to detect the signals related to the noise generating conditions of the plurality of noise sources; and signal component selecting means for separating the signals detected by the noise generating condition sensor into both first and second signal components.

3. An apparatus for reducing noises in a space as set forth in claim 2, wherein the noises generated in the space are noises generated in a vehicle compartment, and wherein said noise generating condition sensor is an acceleration detector installed on a subframe of a vehicle body linked to a vehicular engine and a vehicular suspension member.

4. An apparatus for reducing noises in a space as set forth in claim 2, wherein the noises generated in the space are noises generated in a vehicle compartment and wherein said noise generating condition sensor is an acceleration detector installed on a suspension member to which a differential gear unit and a vehicular suspension are linked.

5. An apparatus for reducing noises in a space as set forth in claim 3, wherein said signal component selecting means predicts and selects which of either signal component is predominant over the other signal component in the noises from among the respective signal components according to a vehicular running condition indicative signal.

6. An apparatus for reducing noises in a space as set forth in claim 5, wherein said vehicular running condition indicative signal includes at least one of engine revolution speed indicative signal, intake air negative pressure indicative signal, suspension longitudinal acceleration indicative signal, and vehicular vibration acceleration indicative signal.

7. An apparatus for reducing noises in a space as set forth in claim 6, wherein said signal component selecting means selects the first signal component when the engine revolution speed indicative signal indicates that the engine revolution speed falls in a predetermined speed range from R1 to R2.

8. An apparatus for reducing noises in a space as set forth in claim 6, wherein said signal component selecting means selects the first signal component when the intake air negative pressure indicative signal indicates that the intake air negative pressure is below a predetermined threshold value Pl as a determination factor of abrupt acceleration of the vehicular engine.

9. An apparatus for reducing noises in a space as set forth in claim 6, wherein said signal component selecting means selects the second signal component when the suspension longitudinal acceleration indicative signal indicates that the suspension longitudinal vibration exceeds a predetermined value of G1.

10. An apparatus for reducing noises in a space as set forth in claim 1, wherein said third means compares said first signal component and second signal component in terms of their amplitudes and selects one of the signal components which is higher in amplitude than the other signal component.

11. An apparatus for reducing noises in a space as set forth in claim 10, wherein a predetermined coefficient k is added to said second signal component and compares a level of said first signal component and that of said second signal component to which the predetermined coefficient k is added, the predetermined coefficient k being determined according to a result of sensory inspection for the noises.

12. An apparatus for reducing noises in a space as set forth in claim 4, wherein said acceleration detector is installed on a rear banjo-type axle housing.

13. An apparatus for reducing noises in a space as set forth in claim 12, wherein another acceleration detector is installed on a subframe of a vehicle body linked to a vehicular engine and a front suspension member.

14. An apparatus for reducing noises in a space as set forth in claim 3, wherein said control sound source includes a plurality of loud speakers located at the evaluation area in the vehicle compartment.

15. An apparatus for reducing noises in a space as set forth in claim 14, wherein said first means includes a plurality of microphones located at respective predetermined positions in the vehicle compartment.

16. An apparatus for reducing noises in a space as set forth in claim 15, wherein the residual noise signal el(n) detected by an l number microphone is expressed as follows:

$$el(n) = epl(n) + \sum_{m=1}^{M} \sum_{j=0}^{Ic-1} Clmj \left\{ \sum_{i=0}^{Ik-1} Wmi \times (n - j - i) \right\},$$

wherein epl(n): the residual noise signal detected by an l number microphone when no control sound is present from the loud speakers, Clmj: the predetermined filter coefficient corresponding to a J number (J=0,1,2,---, Ic−1) (Ic:constant) transfer function Hlm (FIR function) between the m number loud speaker and l number microphone, x(n): reference signal which is selected from either of the first or second signal component, (n): a sampled value at a time n, Wmi: an i number predetermined filter coefficient of the adaptive filter to drive the m number loud speaker upon receipt of the reference signal x(n), M: the number of loud speakers, Ic: the number of taps of the filter coefficients Clm expressed by an FIR ditital filter, and Ik : the number of taps of the filter coefficients Wmi of the adaptive filter.

17. An apparatus for reducing noises in a space, comprising:

a) control sound source means for generating a control sound to be interfered with the noises at an evaluation area of the space so as to reduce the noises at the evaluation area;

b) residual noise detecting means for detecting a residual noise at a predetermined position of the space after the interference with the noise;

c) a single noise generating condition sensor which is so constructed as to detect signals related to noise generating conditions of a plurality of noise sources;

d) signal component separating means for separating the detected signals from the noise generating condition sensor into both first and second signal components, said first signal component having a relatively high auto-correlated function characteristic and said second signal component having a random characteristic;

e) separated signal component selecting means for selecting either first or second signal component which is predominant in the noises in the space over the other signal component;

f) an adaptive digital filter which is so constructed as to adaptively filter process the selected signal component from the separated signal component selecting means through adaptively determined filter coefficients and to output a drive signal to drive the control sound source means; and g) an adaptive controller which is so constructed as to update the adaptively determined filter coefficients through a predetermined control algorithm on the basis of the output signal of the residual noise detecting means and selected signal component from said separated signal component selecting means to reduce the detected residual noise.

* * * * *